United States Patent [19]

Gandy

[11] 4,098,508

[45] Jul. 4, 1978

[54] BALL HANDLING ARTICLE

[76] Inventor: Robert W. Gandy, 2902 Waterway Ct., Apt. 1556, Tampa, Fla. 33612

[21] Appl. No.: 750,644

[22] Filed: Dec. 15, 1976

[51] Int. Cl.[2] ..... A63B 59/02

[52] U.S. Cl. ..... 273/96 R

[58] Field of Search ..... 273/96 R, 96 B, 96 C

[56] References Cited

U.S. PATENT DOCUMENTS

| | | | |
|---|---|---|---|
| 642,638 | 2/1900 | Smith | 273/96 R |
| 1,022,186 | 4/1912 | Engler | 273/96 R |
| 1,593,577 | 7/1926 | Kaiser | 273/96 R |
| 1,972,803 | 9/1934 | Taylor | 273/96 R |
| 2,029,790 | 2/1936 | Phlipp | 273/96 R |
| 3,170,688 | 2/1965 | Porter | 273/96 R |

FOREIGN PATENT DOCUMENTS

| | | | |
|---|---|---|---|
| 771,588 | 7/1934 | France | 273/96 R |
| 1,089,248 | 9/1954 | France | 273/96 R |
| A64,794 | 6/1955 | France | 273/96 R |
| 1,120,225 | 4/1956 | France | 273/96 R |
| 1,283,972 | 1/1962 | France | 273/96 R |

*Primary Examiner*—William H. Grieb

*Attorney, Agent, or Firm*—Stein & Frijouf

[57] ABSTRACT

An article for catching and throwing a ball is disclosed comprising an integral plastic body member having a tip portion and a hand receiving portion. The article includes means for securing the hand of a player to the hand receiving portion. The plastic member has integral side walls extending between the tip portion and the hand receiving portion forming a ball receiving region therebetween. The integral plastic member has a partially arcuate configuration enabling the player to catch and throw the ball from the ball receiving region. The article includes resilient means secured to the ball receiving region for absorbing a portion of the impact of a moving ball to facilitate catching the ball. One embodiment of the invention comprises an improved cesta article currently used for the game of Jai-Alai. This particular embodiment is adapted to enable the playing of a game similar to Jai-Alai on existing handball and racketball courts. The foregoing abstract is merely a resume of one general application, is not a complete discussion of all principles of operation or applications, and is not to be construed as a limitation on the scope of the claimed subject matter.

9 Claims, 12 Drawing Figures

FIG. 1
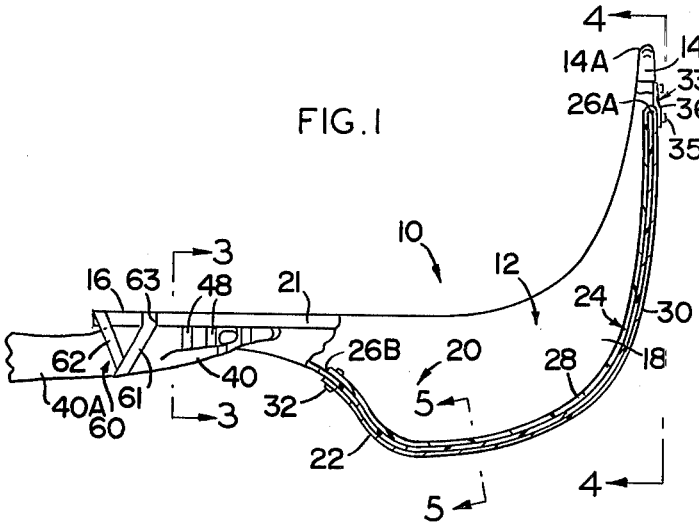
FIG. 3
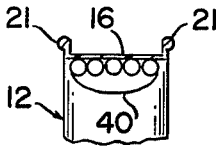
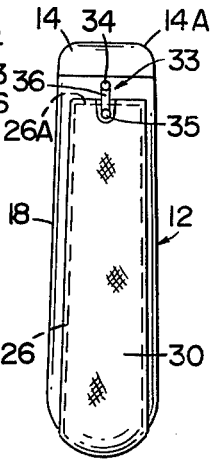
FIG. 4
FIG. 8
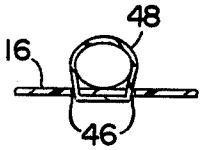
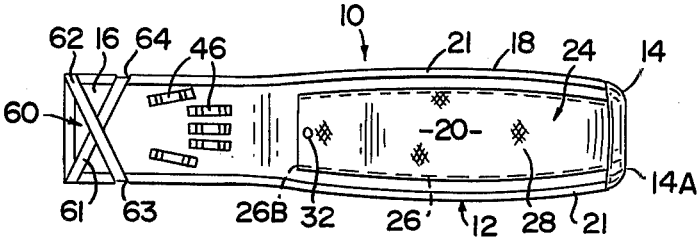
FIG. 2
FIG. 5
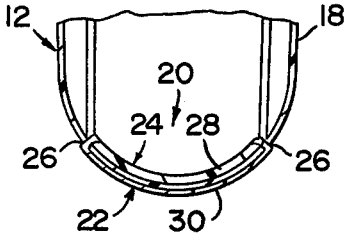
FIG. 6
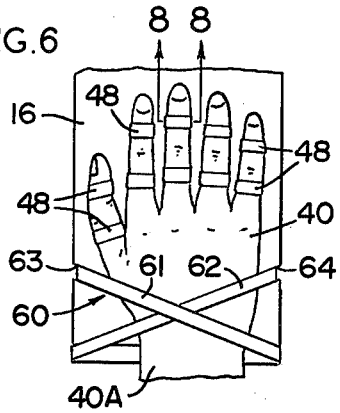
FIG. 7
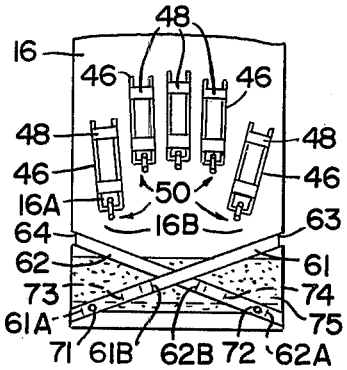
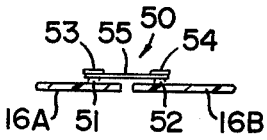
FIG. 9
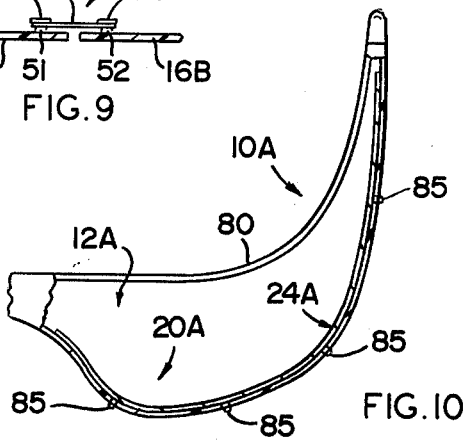
FIG. 10
FIG. 11
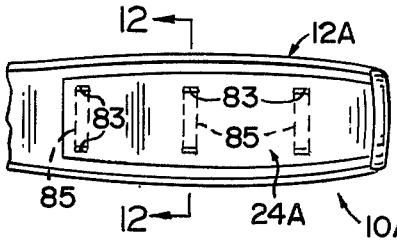
FIG. 12
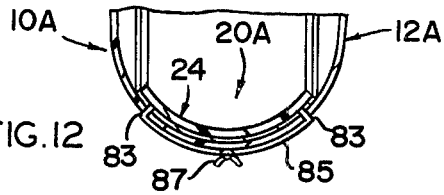

BALL HANDLING ARTICLE

BACKGROUND OF THE INVENTION

1. Field of the Invention

This invention relates to amusement devices and more particularly to games having an aerial projectile combined with a projector and catcher.

2. Description of the Prior Art

There have been many articles known to the prior art for catching and throwing a ball or projectile. Many games have been devised incorporating an article for both catching the ball and for throwing the ball. One of the most significant games incorporating such an article is the game of Jai-Alai which is currently played in only a few states of the United States. The game of Jai-Alai uses a ball handling device called a cesta which is a basketlike article made of plant fibers woven into a substantially rigid member. The Jai-Alai player inserts his hand into a glove type member sewed to the cesta. The cesta is further attached by a cloth strap secured about the player's wrist. U.S. Pat. No. 642,638 shows a cesta which is substantially similar to the cestas presently used in the game of Jai-Alai.

Probably the most significant reason why the game of Jai-Alai has not attained the popularity of other games is the limited number of places in which the game may be played. The game of Jai-Alai is played inside buildings called Frontons. Currently, Frontons exist in only four states in the United States. In addition, the game is very difficult to learn how to play, and in particular, very difficult to learn how to catch a ball in the cesta. The ball is extremely hard and moves very rapidly resulting in a tendency to bounce out of the ball receiving region of the cesta for the novice player.

Therefore it is an object of this invention to provide an article which overcomes the aforementioned inadequacies of the prior art devices and provides an improvement which is a significant contribution to the advancement of the pertinent art.

Another object of this invention is to provide an article for catching and throwing a ball which is a substantial improvement upon the prior art cesta and made of an integral body member for adapting a Jai-Alai-type game to be played on conventional handball and racketball courts.

Another object of this invention is to provide an article for catching and throwing a ball having a hand securing means for securing the hand of the player to the integral body member which is adaptable to fit many sizes of players hands.

Another object of this invention is to provide an article for catching and throwing a ball including a resilient material secured to the ball receiving region of the article for absorbing a portion of the impact of a moving ball to facilitate catching the ball.

Another object of this invention is to provide an article for catching and throwing a ball comprising an integral plastic body member having a tip portion, a hand receiving portion, and a ball receiving region, with resilient metal means inserted in the integral plastic member for reinforcing the ball receiving region.

Another object of this invention is to provide an article for catching and throwing a ball comprising an integral plastic body member having a tip portion, a hand receiving portion and a ball receiving region with slot means in the integral plastic member for removably receiving resilient means in the ball receiving region to absorb a portion of the impact of catching the ball for facilitating learning the process of catching a ball with the article by a novice player.

Another object of this invention is to provide an article for catching and throwing a ball comprising an integral plastic body member which may be constructed economically and which is of a size and shape for adapting the game of Jai-Alai to be played on conventional handball and racketball courts.

Other objects and a fuller understanding of this invention may be had by referring to the summary of the invention, the description and the claims, taken in conjunction with the accompanying drawings.

SUMMARY OF THE INVENTION

The invention may be incorporated into an article for catching and throwing a ball comprising an integral body member having a tip portion and a hand receiving portion. Hand securing means are provided for securing the hand of a player to the hand receiving portion of the integral body member. The body member may be made of a plastic material includes integral sidewall means extending between the tip portion and the hand receiving portion forming a ball receiving region therebetween. The integral plastic member has a partially arcuate configuration enabling the player to catch and throw the ball from the ball receiving portion.

The article may include resilient means secured to the ball receiving region for absorbing a portion of the impact of a moving ball to facilitate catching the ball. A resilient metal may be inserted in the integral body member for reinforcing the ball receiving region. The hand securing means may include means for securing each individual finger of the player's hand to the ball receiving portion. Slot means may be formed in the integral body member for securing the resilient means to the ball receiving region to absorb a portion of the impact of catching the ball through compression of the resilient means upon impact.

The hand securing means may comprise a plurality of slots in the hand receiving portion of the integral body member for receiving a plurality of loops for securing each individual finger of the player's hand to the hand receiving portion. The article may include a web cooperable with the hand receiving portion for securing a portion of the wrist of the player to the integral body member. Integral reinforcement may be provided at the tip of the integral body member and along the sidewalls thereof.

This invention accordingly comprises an article possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in conjunction with the accompanying drawings, in which:

FIG. 1 is a side view, partially in section, of a first embodiment of the improved ball handling article;

FIG. 2 is a top view of the article shown in FIG. 1;

FIG. 3 is a sectional view along line 3—3 of the article shown in FIG. 1;

FIG. 4 is an elevational view along line 4—4 of the article shown in FIG. 1;

FIG. 5 is an enlarged sectional view along lime 5—5 of a portion of the article shown in FIG. 1;

FIG. 6 is an enlarged bottom view of the hand receiving portion of the article shown in FIG. 1;

FIG. 7 is a top view of the hand receiving portion of the article shown in FIG. 1;

FIG. 8 is a sectional view along line 8—8 in FIG. 6;

FIG. 9 is a magnified sectional view of a snap assembly of FIG. 7;

FIG. 10 is a partial view of an article which is a modification of the invention shown in FIG. 1;

FIG. 11 is a top elevational view of the article shown in FIG. 10; and

FIG. 12 is an enlarged sectional view along line 12—12 of FIG. 11.

Similar reference characters refer to similar parts throughout the several views of the drawings.

DETAILED DESCRIPTION

FIGS. 1-9 show various views of the preferred embodiment of an article 10 for catching and throwing a ball comprising an integral body member 12 having a tip portion 14 and a hand receiving portion 16. The body member 12 includes integral sidewall means 18 which extend between the tip portion 14 and the hand receiving portion 16 forming a ball receiving region 20. The body member 12 may include an integral reinforced tip portion 14A in addition to integral reinforcement 21 along the sidewall means 18 of the integral body member 12. The integral body member has at least a partially arcuate configuration forming a belly 22 of the article enabling a player to catch and throw the ball from the ball receiving region. The primary purpose of the belly 22 is to prevent the ball from coming up and over the hand receiving portion 16 upon catching the ball. This also serves as the primary area for catching the ball for novice players.

The integral body member is preferably constructed of a durable, lightweight, semi-flexible material, preferably made of a plastic material. The physical dimensions of one embodiment of the article is smaller than the conventional Jai-Alai cesta since the ball will be thrown a shorter distance and excessive elongation of the cesta is not necessary when playing a Jai-Alai type game on a conventional handball and racketball courts.

The invention may include resilient means 24 secured to the ball receiving region 20 for absorbing a portion of the impact of a moving ball to facilitate catching of the ball by a novice player. The resilient means 24 may be secured through a U-shaped slot 26 in the integral body member extending from slot portion 26A to slot portion 26B with the bottom of the U being located at slot portion 26A. The resilient means 24 may be a tubular resilient material which is slipped on the U-shaped slot 26 from slot portion 26A. In this embodiment the resilient means 24 is shown having a tubular securing material 30 such as nylon bonded to a resilient material 28 located on the ball receiving region. The securing material 30 may be slipped on the U-shaped slot 26 from slot portion 26A to extend to slot portion 26B such that the resilient material 28 is established on the ball receiving portion with only the securing material 30 located on the external portion of the body member 12. Means are provided for securing the resilient means 24 to the body member 12, and in this embodiment, includes a snap assembly 32, one half of the snap assembly being secured to the body member 12 cooperable with another portion secured to the securing material 30. Another snap assembly 33 comprises a first snap 34 on one portion of the body member 12 cooperating with a second snap 35 on another portion of the body member 12 through a web 36. Snap assembly 33 adds mechanical strength to the central portion of the body member 12 while maintaining the resilient means 24 in a stable position.

The hand receiving portion 16 is shown in FIGS. 1-3 and 5-8 and provides means for securing the hand 40 of the player to the article 10. The hand securing means specifically comprises a plurality of U-shaped slots 46 and in this embodiment five slots substantially symmetrically disposed about the hand receiving portion 16 for accommodating either a right or a left hand of a player. Each of the U-shaped slots can accommodate a plurality of web-like finger holds 48 for securing each individual finger to the hand receiving portion 16. Each finger hold may be an endless elastic web loop which is slipped on each of the U-shaped slots 46 for securing the fingers of the player as shown in FIGS. 6 and 8. A snap assembly 50 is associated with each of the U-shaped slots 46 and is shown in greater detail in FIGS. 7 and 9. The portion 16A of the hand receiving portion 16 is connected to portion 16B by the snap assembly 50 comprising a first and a second snap 51 and 52, respectively secured to portions 16A and 16B. Snap members 53 and 54 interconnected by a web 55 cooperate with first and second snaps 51 and 52 respectively, to interconnect the portions 16A and 16B. The snap assemblies add mechanical strength and secure the finger holds 48. The snap assembly 33 shown in FIG. 4 may be substantially identical to the snap assembly 50 shown in FIG. 9.

The invention may include web means 60 for securing the article 10 to the wrist 40A of the player. The web means may include a first and a second web 61 and 62 cooperating with notches 63 and 64 in the hand receiving portion 16. The beginning portions 61A and 62A of webs 61 and 62 are secured to the hand receiving portion 16 by snaps 71 and 72, respectively. The terminal portions 61B and 62B of webs 61 and 62 are secured to the beginning portions 61A and 62A by securing means 73 and 74. The securing means 73 and 74 may be interlocking devices, such as those sold under the trademark "VELCRO." It should be understood that a single web may be incorporated with a variety of securing means to secure the wrist 40A to the hand receiving portion 16. Alternatively, the webs 61 and 62 may be secured to a bed of "VELCRO" 75 on the bottom side of the hand portion 16 as shown in phantom in FIG. 7.

FIGS. 10-12 illustrates a second embodiment of the invention and more specifically in article 10A having a body member 12A with a ball receiving region 20A. In this embodiment the body member 12A receives a resilient metallic member 80 which is shown as a brace integrally molded into the body member 12A. Metallic member 80 adds mechanical strength to the body member 12A in the ball receiving region 20A.

FIGS. 10 and 11 show the metallic member 80 as two rods or a single U-shaped rod of preferably lightweight material such as aluminum inserted down each side of the integral body member for reinforcement along the sidewall means of the integral body member 12. The resilient aluminum material adds additional strength and durability to the edge of the sidewall means against the repeated contact with the ball, particularly when the player does not properly catch the ball.

FIGS. 11 and 12 illustrate the resilient means 24A secured to the body member 12A by a plurality of slots 83 receiving webs 85 which may be secured to one another by tying knots 87 or by other means such as "VELCRO" or the like.

The resilient means 24 and 24A heretofore described may be any suitable resilient material; for example, material sold under the trademark "RESILITE."

It should be noted that the resilient means 24 and 24A is optional and is incorporated into the article 10 for teaching a novice player how to catch a ball with the article 10. After the novice has learned to properly catch the ball in an area closer to the tip region 14, the resilient means 24 and 24A may be removed. In addition, different thicknesses of resilient means 24 and 24A may be incorporated to provide different degrees of impact absorption upon catching the ball. For example, the new player may require a thicker resilient material to absorb a greater impact than a novice with some experience with the ball handling article 10. Although the player's hand 40 has been affixed to the hand receiving portion 16 by a plurality of finger holds 48, it is understood that the player's hand may be secured through a glove with each finger portion of the glove being cooperable with the U-shaped slot 46 for securing the player's hand to the article 10.

The present disclosure includes that contained in the apended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that this invention has been described, what is claimed is:

1. An article for catching and throwing a ball; comprising in combination:

an integral body member having a tip portion, and a hand receiving portion;

hand securing means for securing the hand of a player to said hand receiving portion, said hand securing means including means for recieving at least the fingers of the hand of the player;

said hand securing means further comprising indentation means in said hand receiving portion of said body member for receiving a web for securing the wrist of the player to said hand receiving portion of said integral body member;

said body member having integral side wall means extending between said tip portion and said hand receiving portion forming a ball receiving region therebetween;

said ball receiving region having a first curvature extending from said tip portion and having a second and greater curvature extending from said first curvature to enable the player to catch and throw the ball from said first curvature with said second curvature providing a stop for ctaching and throwing the ball; and resilient layer means secured to said integral body member to cover substantially all of said first curvature of said ball receiving region for absorbing a portion of the impact of a moving ball to facilitate catching the ball.

2. An article as set forth in claim 1, wherein said indentation means includes a notch in the opposed lateral edges of said hand receiving portion of said body member for receiving the web to secure the wrist of the player to said hand receiving portion of said body member.

3. An article as set forth in claim 1, including resilient metal means secured to said integral body member for reinforcing said ball receiving region.

4. An article as set forth in claim 1, wherein said hand securing means includes means for securing each individual finger of the players hand to said hand receiving portion.

5. An article as set forth in claim 1, wherein said hand securing means includes a plurality of slot means in said hand receiving portion of said integral body member; and a plurality of loops cooperable with said plurality of slot means for securing each individual finger of the players hand to said hand receiving portion.

6. An article as set forth in claim 1, wherein said web means includes fastening means for securing one portion of said web to another portion of said web.

7. An article as set forth in claim 1, including an integral reinforced tip portion.

8. An article as set forth in claim 1, including an integral reinforcement along said side wall means of said integral body member.

9. An article for catching and throwing a ball, comprising in combination:

an integral body member having a tip portion and a hand receiving portion;

hand securing means for securing the hand of a player to said hand receiving portion;

said body member having integral side wall means extending between said tip portion and said hand receiving portion forming a ball receiving region therebetween;

said integral body member having a partially arcuate configuration enabling the player to catch and throw the ball from said ball receiving region;

slot means in said integral body member; and resilient means cooperable with said slot means for securing said resilient means to said ball receiving region to absorb a portion of the impact of catching the ball through compression of said resilient means upon impact.

* * * * *

UNITED STATES PATENT AND TRADEMARK OFFICE

CERTIFICATE OF CORRECTION

PATENT NO. : 4,098,508
DATED : July 4, 1978
INVENTOR(S) : Robert W. Gandy

It is certified that error appears in the above-identified patent and that said Letters Patent are hereby corrected as shown below:

Column 3, line 1, delete "lime" and insert --line--;

Column 6, line 2, delete "ctaching" and insert --catching--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*